US009180723B2

(12) United States Patent
Kingsley

(10) Patent No.: US 9,180,723 B2
(45) Date of Patent: Nov. 10, 2015

(54) TEXT MESSAGE ACTIVATED FRAGRANCE SPRAYER

(76) Inventor: Merari Z. Kingsley, Allentown, PA (US)

( * ) Notice: Subject to any disclaimer, the term of this patent is extended or adjusted under 35 U.S.C. 154(b) by 591 days.

(21) Appl. No.: 13/525,951

(22) Filed: Jun. 18, 2012

(65) Prior Publication Data

US 2013/0336704 A1 Dec. 19, 2013

(51) Int. Cl.

| | |
|---|---|
| ***B43K 29/00*** | (2006.01) |
| ***B43K 7/02*** | (2006.01) |
| ***B43K 29/08*** | (2006.01) |
| ***B43K 29/20*** | (2006.01) |
| ***A45D 34/02*** | (2006.01) |

(52) U.S. Cl.

CPC ..... *B43K 29/00* (2013.01); *A45D 34/02* (2013.01); *B43K 7/02* (2013.01); *B43K 29/004* (2013.01); *B43K 29/08* (2013.01); *B43K 29/20* (2013.01); *A45D 2200/057* (2013.01); *A45D 2200/20* (2013.01)

(58) Field of Classification Search

CPC ..... A45D 34/02

USPC ..... 401/190, 195, 209, 137, 289, 258–260; 222/181.2; 239/289

See application file for complete search history.

(56) References Cited

U.S. PATENT DOCUMENTS

| | | | | |
|---|---|---|---|---|
| 4,244,525 | A * | 1/1981 | Manna | 239/289 |
| 5,855,297 | A * | 1/1999 | Tichenor et al. | 222/61 |
| 7,477,148 | B2 * | 1/2009 | Lynn et al. | 340/540 |
| 8,181,826 | B2 * | 5/2012 | Wainwright | 222/181.2 |
| 2006/0086824 | A1 * | 4/2006 | Pearce et al. | 239/337 |

* cited by examiner

*Primary Examiner* — Paul R Durand
*Assistant Examiner* — Thomas M Abebe
(74) *Attorney, Agent, or Firm* — Sanford J. Piltch

(57) ABSTRACT

A self-contained battery-powered portable fragrance sprayer activated by a text message received by wireless signal that initiates the fragrance dispersal.

4 Claims, 1 Drawing Sheet

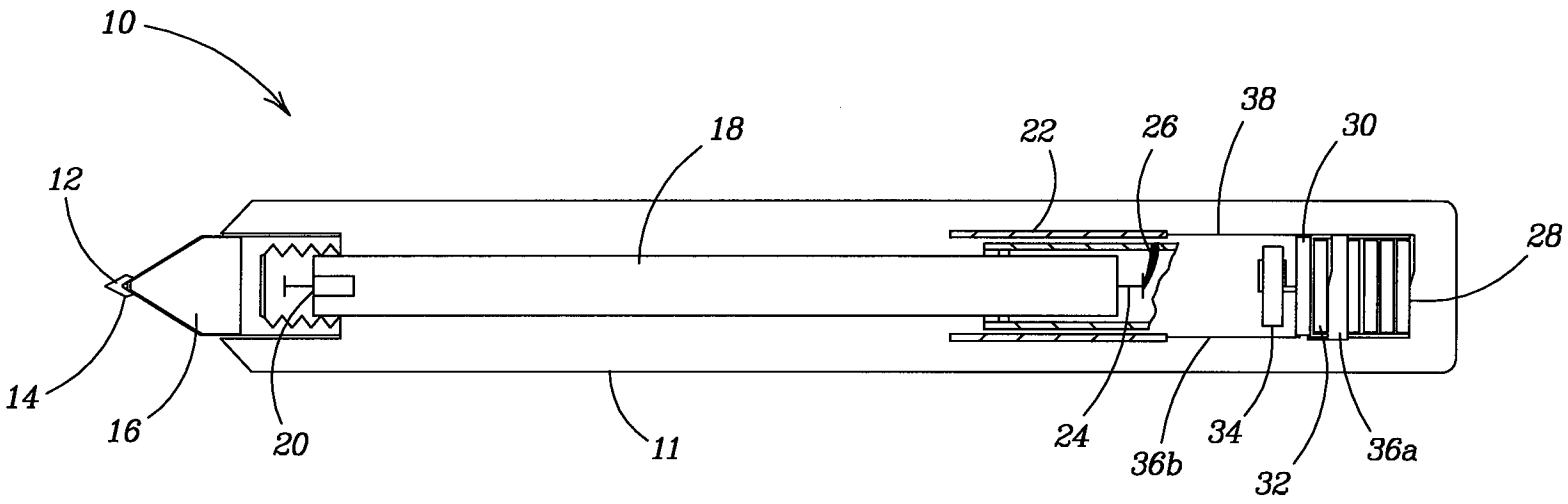
10
12
14
16
20
18
22
26
24
38
30
28
36a
32
34
36b
11

TEXT MESSAGE ACTIVATED FRAGRANCE SPRAYER

BACKGROUND OF THE INVENTION

This invention utilizes the cellphone texting function and the wireless relay function of many cellphones to control local area networked wireless devices. The invention relates to the distant automatic function of releasing a fragrance from a container where the release is controlled by a wirelessly linked local network to a cellphone that is capable of receiving a specific text message designed for the control of the fragrance sprayer.

It is an object of the present invention to control the dispersal of fragrance from a container by using a control text message to initiate the spraying function. It is a further object of the invention to initiate the spraying function using a wireless control signal that is carried over the local area network of rf wireless paired devices.

Other objects will appear hereinafter.

SUMMARY OF THE INVENTION

A fragrance sprayer is controlled for fragrance dispersal by an rf control signal carried over a local area wireless network between a cellphone and a paired network device located within the fragrance sprayer. The control signal is initiated at a distant location by a cellphone user by sending a text message containing a fragrance spraying control command that is relayed from a local receiving cellphone through its local area wireless network to a paired receiver in the fragrance spraying device. Upon receiving the command signal, the fragrance sprayer activates and releases a measured amount of fragrance into the immediate area of the sprayer.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

FIG. 1 is a sectional view of the fragrance sprayer of the present invention.

DETAILED DESCRIPTION OF THE PREFERRED EMBODIMENTS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Referring now to the drawings in detail, where like numerals refer to like parts or elements, there is shown in FIG. 1 a fragrance spraying device 10 that is wirelessly linked to a paired cellphone (not shown) as will be described below. The fragrance spraying device 10 is presented in the form of a writing implement with an outer housing 11 that has at its leftmost end a stylus tip 12 that includes an ink ball 14 and ink reservoir 16. Hence, the writing mechanism for the device 10 is entirely housed within the stylus tip 12. Immediately adjacent and behind the stylus tip 12 is fragrance container 18 capped by a discharge valve 20. The fragrance container 18 is shown as a cylindrical container that extends along the length of the device 10 with its distal end positioned within an electrically operable solenoid 22. Located at the distal end of the fragrance container 18 is a spring loaded valve 24 for releasing the fragrance. When activated the solenoid 22 causes a lever 26 to contact the valve 24 depressing the valve 24 inward as the solenoid draws the lever towards the valve 24. When deactivated the solenoid returns to it's at rest position with the lever 26 pushed away from the fragrance container 18 by the spring loaded valve 24. Lever 26 is attached to the moveable core of the solenoid 22 so that the lever 26 and core move as a unit when the solenoid 22 is activated.

Powering the solenoid 22 is a plurality of batteries 28 located at the extreme distal end of the device 10. The batteries 28 are shown as being of the wafer type that are usually 1.5 vdc for each of the four batteries shown. The number and voltage of the batteries 28 is dependent upon the voltage required for the solenoid 22 to operate. Interposed between the solenoid 22 and the batteries 28 is a switch coupled to a Bluetooth® receiver 30. This receiver/switch 30 is powered by its own 3.0 vdc battery 32 and utilizes a mini-antenna 34 to communicate within the local area wireless network and receive the command instruction to close the switch activating the solenoid 22. Upon receipt of the command instruction, the switch 30 is closed connecting the batteries 28 to the solenoid 22 via wires 36*a*, 36*b*. The neutral or ground wire 38 is on the other side of the solenoid 22 and connects the solenoid 22, the receiver/switch 30, the battery 32 and the batteries 28.

Upon receipt of the command signal from the linked cellphone over the wireless local area network, the receiver/switch 30 is energized to close resulting in the powering of the solenoid 22 so that the solenoid 22 moves the lever 26 inward against the fragrance container 18 and valve 24 to initiate a fragrance spray from the container 18. The Bluetooth® receiver 30 is pre-programmed to pair with the Bluetooth® transceiver of the cellphone within the wireless local area network. The linked cellphone responds to the fragrance spray command text message by initiating a command signal to the paired Bluetooth® receiver 30 that energizes the switch portion of the receiver/switch 30 and powers the solenoid 22 releasing a spray of fragrance from the container 18. In this way a distant cellphone can cause the fragrance to be sprayed as long as the device 10 is within communications range of its paired cellphone.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

The invention claimed is:

1. A fragrance spraying apparatus comprising:

an elongated cylindrical housing containing a fragrance reservoir and an externally controlled valve for dispersing the fragrance;

said valve located at one end of the fragrance reservoir and operated by an arm connected to an electrically operated solenoid;

a wireless receiver paired to a wireless transmitter and responsive to a command signal for activating the solenoid and causing the lever to depress the valve dispersing the fragrance;

said command signal for initiating the dispersal for the fragrance being a special text message received by a limited area network telecommunications device paired to the wireless receiver of the fragrance spraying apparatus, whereby the fragrance contained within the reservoir is dispersed in the immediate vicinity of the fragrance spraying apparatus.

2. The fragrance spraying apparatus of claim 1, wherein the elongated cylindrical housing is configured as a writing implement with a writing stylus at one end.

3. The fragrance spraying apparatus of claim 1, wherein the wireless receiver and the electrically operated solenoid are separately battery powered.

4. The fragrance spraying apparatus of claim 1, wherein the wireless receiver acts as a switch to activate the solenoid upon receipt of the command signal.

* * * * *